US005392937A

United States Patent [19]

Prevot et al.

[11] Patent Number: 5,392,937

[45] Date of Patent: Feb. 28, 1995

[54] FLEX AND GRIP PANEL STRUCTURE FOR HOT-FILLABLE BLOW-MOLDED CONTAINER

[75] Inventors: Roger M. Prevot, Felton, Pa.; Frank E. Semersky, Toledo, Ohio

[73] Assignee: Graham Packaging Corporation, York, Pa.

[21] Appl. No.: 115,652

[22] Filed: Sep. 3, 1993

[51] Int. Cl.[6] ..... B65D 1/02; B65D 23/00; B65D 23/10

[52] U.S. Cl. ..... 215/1 C; 215/100 A; 220/609; 220/675; 220/771

[58] Field of Search ..... 215/1 C, 100 R; 220/771, 675, 666, 669, 609

[56] References Cited

U.S. PATENT DOCUMENTS

| | | | |
|---|---|---|---|
| D. 187,398 | 3/1960 | Vanderhyde . | |
| D. 231,904 | 6/1974 | Boden . | |
| D. 258,117 | 2/1981 | Bashour | D9/403 |
| D. 262,267 | 12/1981 | Cox | D9/383 |
| D. 277,363 | 1/1985 | Drummond et al. . | |
| D. 277,551 | 2/1985 | Kerr | D9/367 |
| D. 279,167 | 6/1985 | Haney et al. | D9/378 |
| D. 281,577 | 12/1985 | Larson et al. | D9/367 |
| D. 282,050 | 1/1986 | Beaver et al. | D9/332 |
| D. 282,349 | 1/1986 | Larson et al. | D9/395 |
| D. 292,378 | 10/1987 | Brandt et al. | D9/396 |
| D. 318,798 | 8/1991 | Biesecker . | |
| 1,636,174 | 7/1927 | Dolan et al. . | |
| 3,536,223 | 10/1970 | Muhihoff et al. | 215/1 C |
| 3,923,178 | 12/1975 | Welker, III | 215/1 C |
| 4,308,955 | 1/1982 | Schieser et al. | 206/509 |
| 4,381,061 | 4/1983 | Cerny et al. | 215/1 C |
| 4,387,816 | 6/1983 | Weckman | 215/1 C |
| 4,610,366 | 9/1986 | Estes et al. | 215/1 C |
| 4,749,092 | 6/1988 | Sugiura et al. | 215/1 C |
| 4,804,097 | 2/1989 | Alberghini et al. | 215/100 A |
| 4,805,788 | 2/1989 | Akiho | 215/1 C |
| 4,890,752 | 1/1990 | Ota et al. | 215/1 C |
| 4,946,053 | 8/1990 | Conrad | 215/1 C |
| 4,993,565 | 2/1991 | Ota et al. | 215/1 C |
| 5,092,474 | 3/1992 | Leigner | 215/1 C |
| 5,092,475 | 3/1992 | Krishnakumar et al. | 215/1 C |
| 5,141,120 | 8/1992 | Brown et al. | 215/1 C |
| 5,141,121 | 8/1992 | Brown et al. | 215/100 A |
| 5,148,930 | 9/1992 | Ota et al. | 215/1 C |
| 5,165,557 | 11/1992 | Ota et al. | 215/1 C |
| 5,199,587 | 4/1993 | Ota et al. | 215/1 C |
| 5,226,550 | 7/1993 | Mikolaitis et al. | 215/1 C |
| 5,303,834 | 4/1994 | Krishnakumar et al. | 215/1 C |

FOREIGN PATENT DOCUMENTS

| | | | |
|---|---|---|---|
| 1507327 | 11/1966 | France . | |
| 9100829 | 1/1991 | WIPO | 215/1 C |

*Primary Examiner*—Sue A. Weaver
*Attorney, Agent, or Firm*—Howson and Howson

[57] ABSTRACT

A hot-fillable, blow-molded container has a body portion with grip panels extending between a front label panel and a rear palm panel. The container body is configured to accommodate reductions in volume caused by hot-filling, capping, and subsequent cooling of contents in a manner which retains its aesthetic appearance when cooled yet which retains its structural integrity when opened and its contents poured.

3 Claims, 3 Drawing Sheets

FLEX AND GRIP PANEL STRUCTURE FOR HOT-FILLABLE BLOW-MOLDED CONTAINER

FIELD OF THE INVENTION

The present invention relaters to hot-fillable blow-molded plastic containers which to accommodate reductions in volume due to cooling of a liquid hot-filled into the container and subsequently cooled.

CROSS-REFERENCED TO RELATED APPLICATION

The present application is related to a co-pending design application, Ser. No. 29/000,230 filed on Oct. 8, 1992 by the same inventors and commonly owned herewith.

BACKGROUND OF THE INVENTION

A major problem associated with hot-fillable blow-molded containers is the need to accommodate changes in the container configuration due to reductions in volume as the hot-filled liquid cools alter the container has been capped. Some prior art approaches to solving this problem involve the use of flex panels at various locations in the container side wall. Flex panels are designed to move in response to reductions in volume in the containers so that the filled level of the liquid remains at a pre-determined location.

Examples of containers having such panels may be found in U.S. Pat. Nos. 4,749,092; 4,805,788; and 4,946,053. Two recently issued patents having hand grips with flex panels formed in the hand grips are disclosed in U.S. Pat. Nos. 5,141,120 and 5,341,121. Other collapse-resistent containers are disclosed in U.S. Pat. Nos. 3,923,178; 4,381,061; 4,387,816; and 4,610,366. Containers having recessed sidewalls providing handgrips are disclosed in U.S. Pat. No. D282,050.

Although various ones of the referenced containers may function satisfactorily for their intended purposes, there is a need for blow-molded plastic containers which not only accommodate reductions in volume due to cooling of a hot-filled liquid, but which also retain their structural integrity after being opened by a consumer and contents poured from the container. In other words, a desirable container should also be capable of retaining its intended shape when gripped hiring pouring and handling. Furthermore, such a container should also be capable of being molded with a minimum of plastic to minimize costs.

OBJECTS OF THE INVENTION

With the foregoing in mind, a primary object of the present invention is to provide an improved blow-molded, hot-fillable plastic container which overcomes the limitations of known hot-fillable containers.

Another object of the present invention is to provide a novel hot-fillable, blow-molded plastic container having hand grips which facilitate handling and pouring of contents.

A further object of the present invention is to provide a hot-fillable, blow-molded plastic container which not only accommodates reductions in volume due to cooling of hot-filled contents, but also retains its structural integrity throughout its period of utility.

SUMMARY OF THE INVENTION

More specifically, the present invention provides a hot-fillable, blow-molded plastic container particularly suited for containing a liquid filled initially in a hot state and subsequently sealed so that cooling of the liquid creates a reduced volume of the liquid in the container. The container includes a bottom portion having a circular cross-section, a shoulder portion having a circular cross-section corresponding to the cross-section of the bottom portion, and aligned vertically with the bottom portion. A closable neck portion is provided on the shoulder portion to permit filling and discharge of liquid from the container. The container has a body portion which connects the bottom portion and the shoulder portion in which the improvement of the present invention is provided.

The improvement comprises an arcuate front label panel which extends between the bottom and shoulder portions, an arcuate rear palm panel located diametrically opposite the front label panel and extending likewise between the bottom and shoulder portions. A pair of flex panels are set inwardly from, and extend between, the shoulder and bottom portions on opposite sides of the container. The flex panel extends between the front label panel and rear palm panel, and each has formed therein a rigid grip structure for receiving a person's thumb and fingers on opposite sides of the container when the palm panel is engaged by the person's palm. The grip structures are deeper closer to the front label panel than to the rear palm panel and are formed to resist inverting in response to changes in volume of the liquid within the container. Each of the flex panels has a substantially rectangular elevational configuration with its lengthwise dimension being disposed vertically. Vertical stiffening ribs extend lengthwise of each flex panel between the bottom and shoulder portions adjacent the front label panel and the rear palm panel. Each panel has upper and lower chordal stiffening means extending horizontally between the front and rear panels and the flex panels stiffening ribs. Each flex panel, as manufactured, has a slightly outwardly-bowed convex configuration so that when filled, closed, and cooled, the flex panels can flex inwardly without effecting unwanted distortion of the container and thereby affecting adversely the level of fluid charged into the container prior to capping.

BRIEF DESCRIPTION OF THE DRAWINGS

These and other objects features and advantages of the present invention should become apparent from the following description when taken in conjunction with the accompanying drawings, in which.

DESCRIPTION OF THE PREFERRED EMBODIMENT

Figure 1:
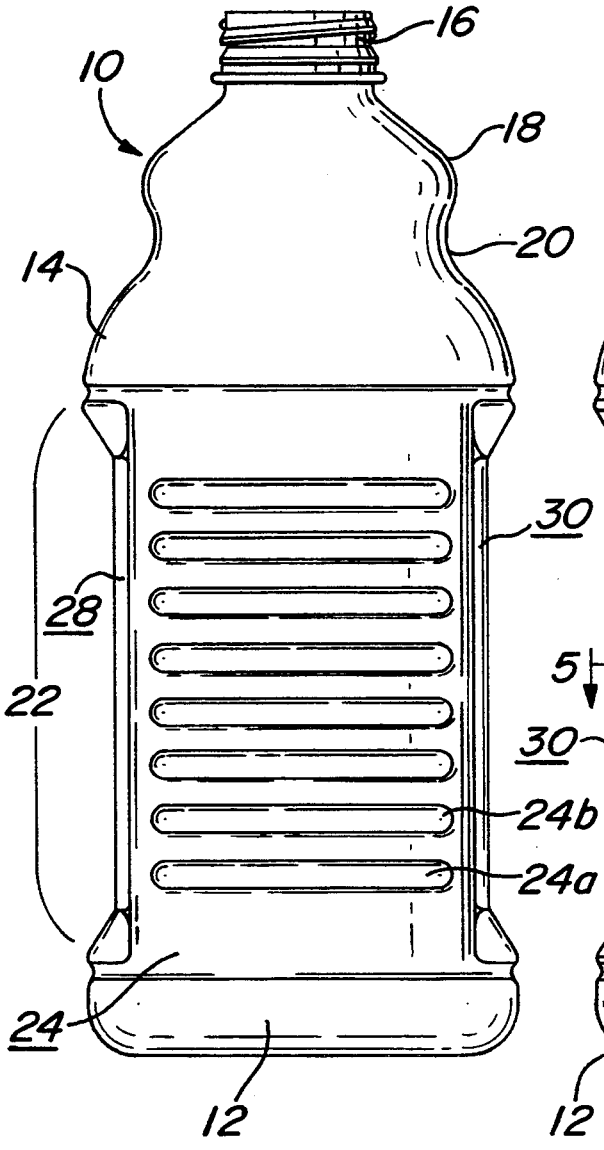
FIG. 1 illustrates a front elevational view of a hot-fillable, blow-molded plastic container embodying the present invention.

Referring now to the drawings, FIG. 1 illustrates a hot-fillable, blow-molded plastic container 10 which embodies the present invention. The container 10 is particularly suited to be filled with a liquid initially in a hot state and subsequently sealed. As the liquid cools, its volume decreases in the sealed container.

As discussed heretofore, various container designs have been proposed to accommodate the reduction in volume in a manner which retains the aesthetics of the container. These designs have met with varying degrees of success. The present invention overcomes the limitations of the prior art containers by means of a novel combination of structural elements which cooperate to provide a commercially-desirable container which retains its appearance before opening and its structural integrity after opening and use by the consumer.

To this end, the container 10 has a bottom portion 12 with a circular cross section and a circular shoulder portion 14 aligned vertically with the bottom portion 12. A neck 16, which may be threaded as illustrated, is connected to the shoulder portion 14 by a double-domed wall 18 having a circumferential finger grip indentation 20. A cap (not shown) closes the neck 16 to seal the container 10.

The novel portion of the container 10 is found in the body portion 22 which extends between the shoulder portion 14 and the bottom portion 12. The body portion 22 comprises an arcuate front label panel 24 which extends vertically between the bottom 12 and the shoulder 14 and is of the same arcuate extent throughout. The front label panel 24 has a plurality of horizontally extending inwardly recessed reinforcing channels 24*a*, 24*b* which extend in vertically spaced relation throughout substantially the entire vertical extent of the label panel 24. A label (not shown) is adapted to be affixed to the label panel by conventional means, such as an adhesive.

An arcuate rear palm panel 26 is provided in the body portion 22 diametrically opposite the front label panel 24. The rear palm panel 26 is of lesser arcuate extent than the front label panel 24 and, like it, extends vertically between the bottom 12 and shoulder 14. The rear palm panel 26 has a series of horizontally-extending reinforcing channels 26*a*, 26*b* spaced vertically throughout substantially the entire vertical extent of the rear palm panel 26.

Figure 3:
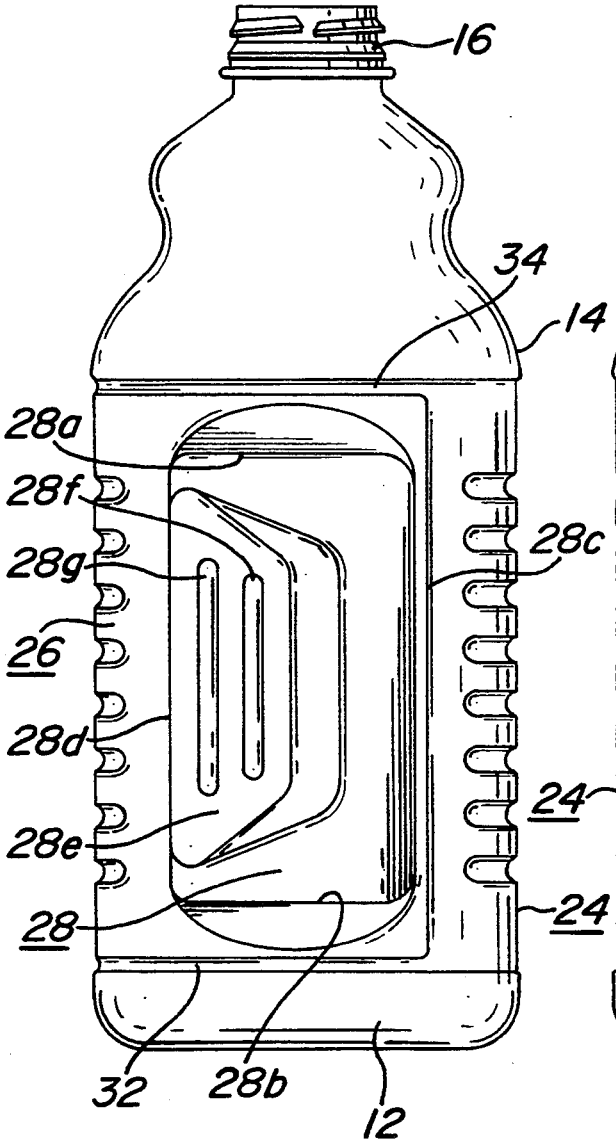
FIG. 3 illustrates one side elevational view thereof.
Figure 4:
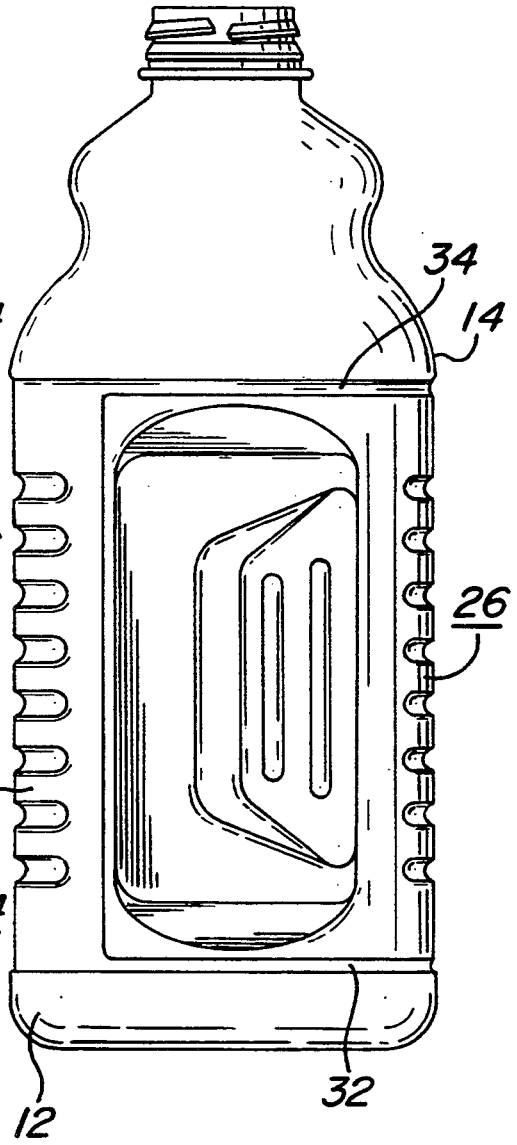
FIG. 4 illustrates the opposite side elevational view thereof.

As best seen in FIGS. 3 and 4, the body portion 22 has a pair of flex panels 28 and 30 extending between the front label panel 24 and the rear palm panel 26 on diametrically opposite sides of the container 10. The flex panels 28 and 30 are of like construction, so that reference will be made hereinafter to the flex panel 28, it being understood that the same description applies with respect to the flex panel 30.

Figure 2:
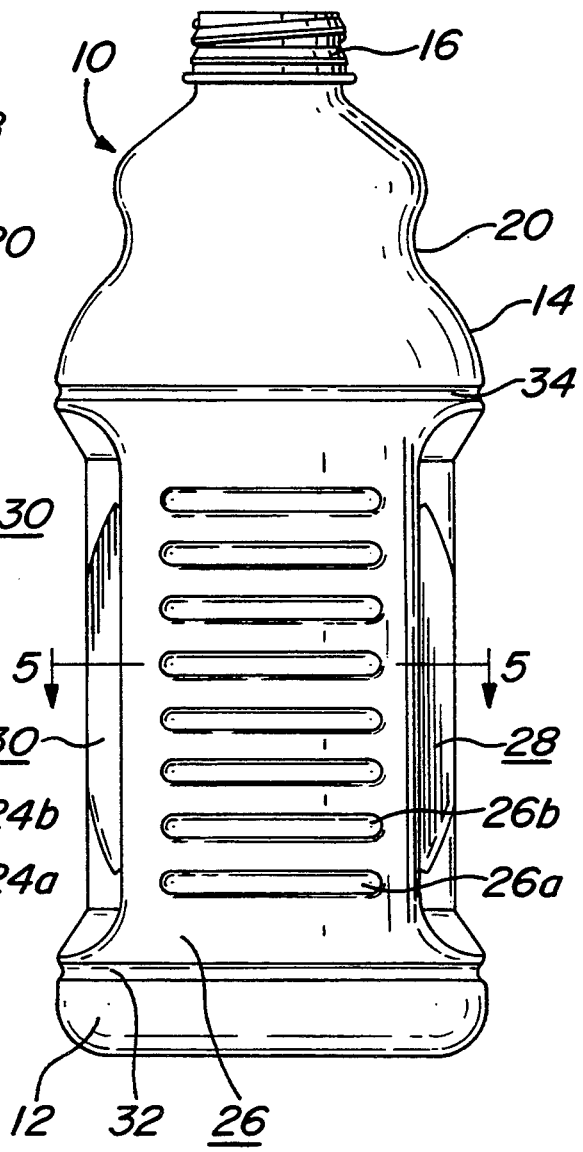
FIG. 2 illustrates a rear elevational view of the container.

Referring specifically in FIGS. 1 and 2, the flex panels 28 and 30 are both inset inwardly from the shoulder 14 and bottom 12 and flare outwardly adjacent their upper and lower ends from horizontally extending inwardly convex upper and lower chordal stiffening means 28*a* and 28*b*, respectively. See FIG. 2. The chordal stiffening means 28*a* and 28*b* extend substantially between the front label panel 24 and the rear palm panel 26 to stiffen the flex panels 28 and 30 adjacent their upper and lower ends. Each flex panel, such as the flex panel 28, has a rectangular elevational configuration between the upper and lower stiffening ribs 28*a* and 28*b* with its lengthwise dimension being disposed vertically. Each flex panel, such as the flex panel 28, has a pair of inwardly concave vertically-extending stiffening ribs 28*c* and 28*d* (FIG. 5) extending vertically between the upper and lower chordal stiffening ribs 28*a* and 28*b* adjacent the front label panel 24 and rear palm panel 26, respectively. As best seen in FIG. 3, the rectangular shape of flex panel 28 is defined by the vertical ribs 28*c*, 28*d* and the horizontal stiffening means 28*a* and 28*b*.

Figure 5:
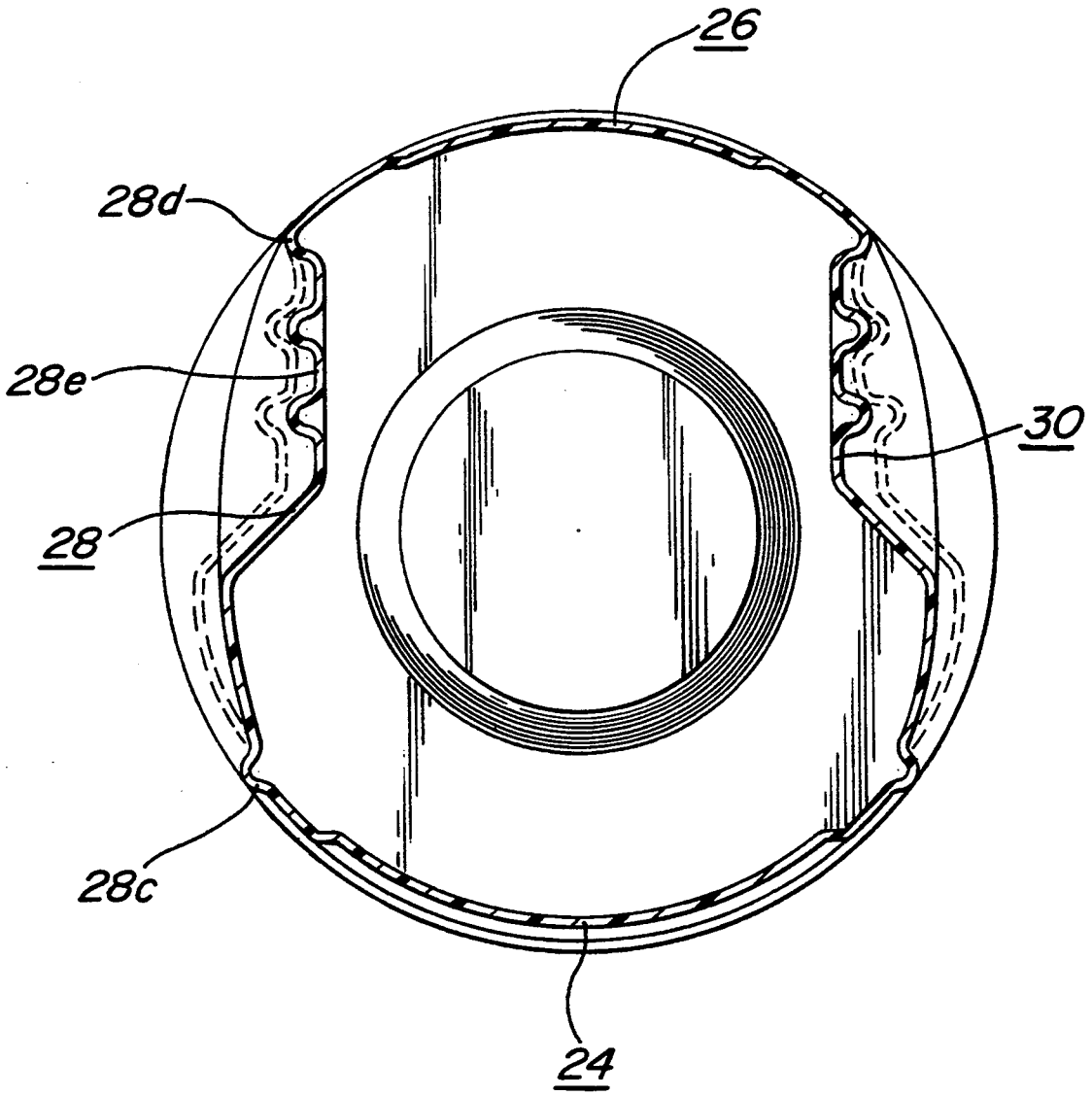
FIG. 5 is an enlarged cross sectional view taken on line 5—5 of FIG. 2.

Each flex panel, such as the flex panel 28, has a rigid inwardly recessed grip structural portion 28*e* of generally trapezoidal shape. The grip structural portion 28*e* has its base located adjacent the rear palm panel 26. As best illustrated in FIG. 5, each grip structural portion 28*e* tapers into the container from the rear palm panel 26. The grip structural portion 28*e* has a pair of vertically extending reinforcing ribs 28*f* and 28*g* to enhance gripability of the grip structures 28 and 30 by the user when the user's palm is engaged with the palm panel 26. As best seen in FIGS. 3 and 4, each grip structure such as 28*e*, is of lesser extent than the flex panel 28 in which it is formed.

As best seen in FIGS. 1–4, a peripheral reinforcing rib 32 extends inwardly above the base 12 continuously about the container 10 from the lower end of the vertically-extending reinforcing rib 28*c* on the flex panel 28 to its counterpart at the same location with respect to the flex panel 30. A similar peripheral reinforcing rib 34 extends in a like manner between the same locations adjacent the shoulder 14.

As initially formed, the container 10 has a slightly outwardly bowed convex configuration in the region between the reinforcing ribs 28*a*, 28*b*, 28*c*, and 28*d*. This causes the entire flex panel 28, and, of course, its companion flex panel 30, to have a slightly convex configuration with respect to the interior of the container 10. Thus, when the container 10 is filled with a liquid at an elevated temperature, capped and sealed, reduction in the volume inside the container due to cooling of the liquid causes the flex panels 28 and 30 to return to the configuration substantially as illustrated in FIG. 5 thereby to accommodate the reduction in volume in the container 10. However, after the container 10 has been opened, and even after some of its contents has been poured, the afore-described structural configuration provides the container 10 with sufficient rigidity to enable it be handled by the consumer without tendency for lateral collapse, particularly when partially filled. As a result, the container 10 can be made relatively thin and yet still retain desirable aesthetics and handling qualities. The illustrated embodiment is a $\frac{3}{4}$ scale of a preferred PET container 10 capable of holding 64 fluid ounces.

While a preferred embodiment of the present invention has been described in detail, various modifications, alterations and changes may be made without departing from the spirit and scope of the present invention as defined in the appended claims.

We claim:

1. In a hot-fillable, blow-molded plastic container for containing a liquid filled initially in a hot state and subsequently sealed, said container including a bottom portion having a substantially circular cross section, a shoulder portion having a cross section corresponding substantially to said cross section of said bottom portion, said bottom and shoulder portions being aligned vertically, a closable neck portion on said shoulder portion permitting filling and discharge of said liquid, and a body portion connecting said bottom portion and said shoulder portion, the improvement wherein said body portion comprises:

an arcuate front label panel extending between said bottom and shoulder portions;

an arcuate rear palm panel located diametrically opposite said front label panel and extending between said bottom and shoulder portions; and a pair of flex panels set inwardly from and extending between said shoulder and bottom portions on opposite sides of said container, said flex panels extending between said front label and rear palm panels and each having formed therein a rigid grip panel for receiving a person's thumb and fingers on opposite sides of said container when said palm panel is engaged by the person's palm, said grip panels tapering into said container from said rear palm panel, and being formed to resist inverting;

each of said flex panels having a substantially rectangular elevational configuration with its lengthwise dimension being disposed vertically;

each flex panel having adjacent said front label panel and said rear palm panel means forming vertical stiffening ribs extending lengthwise of each flex panel between said bottom and shoulder portions;

each flex panel having upper and lower horizontal chordal stiffening means extending horizontally between said front and rear panels and said vertical stiffening ribs;

said vertical stiffening ribs and said upper and lower horizontal chordal stiffening means defining therewithin the rectangular configuration of each flex panel, and each grip structure being of lesser extent than each flex panel; and each flex panel, as manufactured, having a slightly outwardly bowed convex configuration in the region within said vertical stiffening ribs and said upper and lower horizontal chordal stiffening means so that, when filled, closed, and cooled, said flex panels can flex inwardly without effecting unwanted distortion of said container;

whereby said container portions, panels, ribs and means cooperate to maintain the structural integrity of the container after being formed, filled, cooled and later opened.

2. In a hot-fillable, blow-molded plastic container for containing a liquid filled initially in a hot state and subsequently sealed, said container including a bottom portion having a substantially circular cross section, a shoulder portion having a cross section corresponding substantially to said cross section of said bottom portion, said bottom and shoulder portions being aligned vertically, a closable neck portion on said shoulder portion permitting filling and discharge of said liquid, and a body portion connecting said bottom portion and said shoulder portion, the improvement wherein said body portion comprises:

an arcuate front label panel extending between said bottom and shoulder portions, said front label panel being inset from said bottom and shoulder portions and having a series of vertically-spaced reinforcing channels extending substantially the full horizontal extent of said front label panel and extending substantially the full vertical extent of said front label panel;

an arcuate rear palm panel located diametrically opposite said front label panel and extending between said bottom and shoulder portions, said rear palm panel being of lesser arcuate extent than said front label panel; and a pair of flex panels set inwardly from and extending between said shoulder and bottom portions on opposite sides of said container, said flex panels extending between said front label panel and said rear palm panel and each having formed therein a rigid grip structure for receiving a person's thumb and fingers on opposite sides of said container when said palm panel is engaged by the person's palm;

each of said flex panels having a substantially rectangular elevational configuration;

each flex panel having adjacent said front label panel and said rear palm panel means forming vertical stiffening ribs extending vertically of each flex panel between said bottom and shoulder portions, each of said vertical stiffening ribs being concave inwardly of said container;

each flex panel having upper and lower horizontal chordal stiffening means extending between said front and rear panels and said vertical stiffening ribs, each of said horizontal chordal stiffening means being convex inwardly of said container;

said vertical stiffening ribs and said upper and lower horizontal chordal stiffening means defining therewithin the rectangular configuration of each flex panel, and each grip structure being of lesser extent than each flex panel; and each flex panel, as manufactured, having a slightly outwardly bowed convex configuration in the region within said vertical stiffening ribs and said upper and lower horizontal chordal stiffening means so that, when filled, closed, and cooled, said flex panels can flex inwardly without effecting unwanted distortion of said container;

whereby said container portions, panels, ribs and means cooperate to maintain the structural integrity of the container after being formed, filled, cooled and later opened.

3. In a hot-fillable, blow-molded plastic container for containing a liquid filled initially in a hot state and subsequently sealed, said container including a bottom portion having a substantially circular cross section, a convex shoulder portion having a cross section corresponding substantially to said cross section of said bottom portion, said bottom and shoulder portions being aligned vertically, a closable neck portion on said shoulder portion permitting filling and discharge of said liquid, said shoulder portion being necked down below said neck, and a body portion connecting said bottom portion and said shoulder portion, the improvement wherein said body portion comprises:

an arcuate front label panel extending between said bottom and shoulder portions, and having a series of horizontally extending reinforcing channels;

an arcuate rear palm panel of lesser arcuate extent than said front label panel located diametrically opposite said front label panel and extending between said bottom and shoulder portions, said rear palm panel having a series of horizontally extending reinforcing channels; and a pair of flex panels set inwardly from and extending between said shoulder and bottom portions on opposite sides of said container, said flex panels extending between said front label panel and said rear palm panel and each flex panel having formed therein a rigid inwardly recessed grip structure for receiving a person's thumb and fingers on opposite sides of said container when said palm panel is engaged by the person's palm, each grip structure tapering into said container from said rear palm panel and being formed to resist inverting relative to the flex panel in which it is formed, each grip structure having a plurality of vertically-extending ridges;

each of said flex panels having a substantially rectangular elevational configuration with its lengthwise dimension being disposed vertically and its widthwise dimension disposed chordally;

each flex panel having adjacent said front label panel and said rear palm panel vertical stiffening ribs extending lengthwise between said bottom and shoulder portions;

each flex panel having upper and lower horizontal chordal stiffening means extending widthwise between said front and rear panels;

said vertical stiffening ribs and said upper and lower horizontal chordal stiffening means defining therewithin the rectangular configuration of each flex panel, and each grip structure being of lesser extent than each flex panel; and each flex panel, as manufactured, having a slightly outwardly bowed convex configuration in the region within said vertical stiffening ribs and said upper and horizontal chordal stiffening means so that, when filled, closed, and cooled, said flex panels can flex inwardly without effecting unwanted distortion of said container;

whereby said container portions, panels, ribs and means cooperate to maintain the structural integrity of the container after being formed, filled, cooled and later opened.

* * * * *